US006158954A

United States Patent [19]

Nabeshima et al.

[11] Patent Number: 6,158,954

[45] Date of Patent: Dec. 12, 2000

[54] CROSS-FLOW FAN AND AN AIR-CONDITIONER USING IT

[75] Inventors: Noriyuki Nabeshima, Oizumi-machi; Tomohito Takada, Osaka; Michihiro Kurokawa, Hirakata; Tomohito Koizumi, Ota; Yoshinori Toya, Oizumi-machi; Kiyoshi Koyama, Isesaki; Shigeya Ishigaki, Ora-machi, all of Japan

[73] Assignee: Sanyo Electric Co., Ltd., Moriguchi, Japan

[21] Appl. No.: 09/276,791

[22] Filed: Mar. 26, 1999

[30] Foreign Application Priority Data

| | | | |
|---|---|---|---|
| Mar. 30, 1998 | [JP] | Japan | 10-83278 |
| Aug. 20, 1998 | [JP] | Japan | 10-234135 |
| Feb. 10, 1999 | [JP] | Japan | 11-32816 |

[51] Int. Cl.[7] ..... F04D 29/28

[52] U.S. Cl. ..... 415/53.1; 415/119; 416/178; 416/187; 416/203

[58] Field of Search ..... 415/53.1, 53.2, 415/53.3, 119; 416/203, 175, 178, 187; 165/121, 122, DIG. 309, DIG. 314, DIG. 315

[56] References Cited

U.S. PATENT DOCUMENTS

| | | | |
|---|---|---|---|
| 4,538,963 | 9/1985 | Sugio et al. | 416/203 |
| 5,266,007 | 11/1993 | Bushnetll et al. | 416/178 |
| 5,611,667 | 3/1997 | Nagamori et al. | 416/178 |

*Primary Examiner*—Christopher Verdier
*Attorney, Agent, or Firm*—Armstrong, Westerman, Hattori, McLeland & Naughton

[57] ABSTRACT

A number of vanes 12 are disposed in a peripheral direction of a plurality of supporting disks disposed along a rotary shaft 14 at given intervals. Each vane 12 is disposed at an angular interval as determined by a logistic representation. Thereby the intensity and variations of noise levels at around 8N on the low-frequency side, as well as the noise level caused by rotary first-order sounds, can be reduced.

12 Claims, 7 Drawing Sheets

CROSS-FLOW FAN AND AN AIR-CONDITIONER USING IT

FIELD OF THE INVENTION

This invention relates to a cross-flow fan wherein a plurality of vanes are cylindrically disposed around the axis of rotation and an air-conditioner using it.

BACKGROUND OF THE INVENTION

In conventional air-conditioners, wherein air in a room is conditioned by circulating it in the room via a heat exchanger, a cross-flow fan has been used, wherein the air being circulated flows across the fan.

The structure of a room unit for such an air-conditioner equipped with a cross-flow fan is shown in FIG. 6. FIG. 6 is used here, because its overall structure is substantially the same as that of the prior-art device, although it refers to an embodiment of this invention. It is a cross section of the room unit, wherein inlets 1*a* and 7*a* are provided in upper and front covers of a case 1 of the body of the unit, respectively, and wherein an outlet 1*b* is provided in a bottom portion of the body case 1. An air filter 6, a heat exchanger 2, and a cross-flow fan 3 are disposed sequentially in that order in a flow path 5 connecting the inlet 1*a* and the outlet 1*b*.

FIG. 7 is a perspective of the cross-flow fan 3. As shown in it, a plurality of supporting disks 3*b* are disposed on a shaft 3*c* at given intervals therebetween, and also a plurality of vanes 3*a* extend between the supporting disks 3*b*.

Such a cross-flow fan 3 is driven by an electric motor (not shown). The cross-flow fan 3 is disposed such that it is sandwiched between a rear-guider 1*c* and a stabilizer 4 so as to enhance the efficiency of the blowing air.

A tongue-shaped surface 4*a* is formed at the end of the stabilizer 4.

With the thus-structured unit, when the cross-flow fan 3 starts rotating, the warmed air through the heat exchanger 2 is blown from the outlet 1*b* into the room.

At that time a portion of the air blown from the cross-flow fan 3 impinges on the tongue surface 4*a* to be reabsorbed into the cross-flow fan 3, so that large concentric eddies, each of whose axis of rotation is eccentric to that of the cross-flow fan 3, are formed at the outlet part of the cross-flow fan 3.

These eddies are cut by each vane 3*a* to cause variations of pressure, thereby noises are generated.

These noises consist of first-order rotary sounds associated with intervals between adjacent vanes. The frequencies of the first-order rotary sounds are defined by N×Z, where N is the number of rotations per second and Z is the number of vanes 3*a*.

Conventionally it has been proposed that adjacent vanes 3*a* be disposed along the peripheries of the disks, with their intervals therebetween being disposed at random, to reduce the noises of the first-order rotary sounds.

However, it was found that, with vanes 3*a* being disposed at random intervals therebetween, when vanes having low absorbing ability (adjacent vanes disposed at short intervals) exist at both the inlet and outlet sides, the flow of the air from the fan was reduced, and that conversely, when vanes with high absorbing ability exist at both the inlet and outlet sides, the reverse phenomenon was brought about.

Thus, there was a problem in that, depending on the variations of the flow of air, the levels of vibrations and noises increased.

Therefore, the optimum intervals between the vanes 3*a* were determined through an experiment or the like.

However, optimizing the spacing or distribution of intervals of the vanes 3*a* was so difficult that there was a problem in that even if the above-mentioned first-order sounds were successfully reduced, those low frequency (1N–20N) rotary noises, which accompany by the rotations of the vanes 3*a*, were not successfully reduced.

Further, the concerned, parties including the applicant hereof, experimentally certified that a problem was observed when the noise level increased and there existed discontinuous variations thereof in a frequency area at around 8N, and listeners perceived an unpleasant hearing impression.

In view of such problems, this invention was made. The purpose of this invention is to provide a cross-flow fan and an air-conditioner for using it, wherein to realize a cross-flow fan with a low noise level the intensity and variations of the noise level at around 8N on the low-frequency side, as well as the noise level caused by first-order rotary sounds, are reduced, without any unpleasant impression being given to listeners.

SUMMARY OF THE INVENTION

This invention provides a cross-flow fan, wherein a plurality of supporting disks are disposed on a shaft in an axial direction at given intervals therebetween, and wherein a number of vanes are disposed around the supporting disks, characterized in that angular intervals for arranging the vanes, at which angular intervals the vanes are arranged along the peripheries of the supporting disks, are determined by a logistic representation.

By using this constitution the intensity and variations of the level of noises at around 8N on the low-frequency side, as well as the noise level at around a first-order rotary sounds, can be reduced.

Specifically, angular intervals P(n) between the nth and (n+1)th vanes are set so as to meet the following equation 1, when B is assumed to be the total number of vanes disposed in the peripheral direction:

$$P(n)=a+b\times X(n) \tag{1}$$

Where n is an integer from 1 to B, a is a constant from 297/B to 333/B, b is a constant from 2.0 to 3.0, and X(n) is a logistic function to meet following equations 2 and 3:

$$X(n+1)=4\times(1-X(n))\times X(n) \tag{2}$$

$$X(1)=0.1 \tag{3}$$

When an error in manufacturing the angular intervals P(n) is assumed to be δP(n), the effect of this invention will not be impaired, so long as it is within a range wherein the error δP(n) meets the following equation 4:

$$-1.0\leqq\delta P(n)\leqq 1.0 \tag{4}$$

Further, the angular interval P(n) of any vane, for example, the Bth angular interval P(B), can be adjusted so that the total of the angular intervals P(n) of all vanes becomes 360 degrees. In this case, the angular intervals, other than that of the angular-adjusted angular interval P(B), are determined by logistic representations.

In addition, another constitution may be used wherein each of the angular intervals P(n) can be adjusted to each of the angular intervals P'(n), as determined by the following equation 5, respectively:

$$P'(n) = P(n) \times \frac{360}{\sum_{i=1}^{B} P(i)} \quad (5)$$

By using this constitution all the vanes can be arranged in a well-balanced state at angular intervals as determined by logistic representations.

Further, the vanes are sequentially arranged so that their concave or front surfaces face the rotary direction of the cross-flow fan, at angular intervals determined by logistic representations. To enhance the air-blowing efficiency of the thus-constituted cross-flow fan, a rear guider, a discharge outlet, and a stabilizer are sequentially disposed in the direction of rotation of the cross-flow fan. Further, the cross-flow fan is arranged so that its lowest point is positioned higher than the lowest part of the heat exchanger.

DETAILED DESCRIPTION OF THE PREFERRED EMBODIMENT

Figure 1:
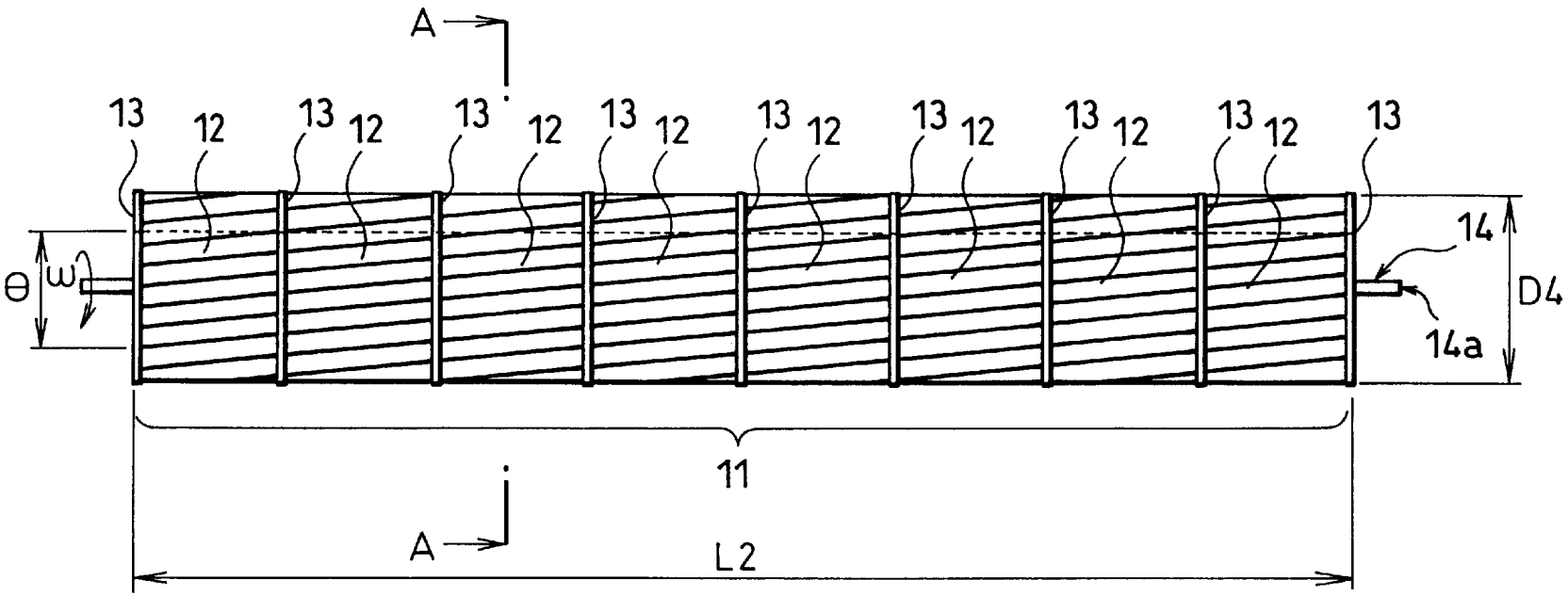
FIG. 1 is a front view showing an embodiment of the cross-flow fan of this invention.

A cross-flow fan 11, made in accordance with the present invention, will now be described by reference to the attached drawings. FIG. 1 is a front view showing an embodiment of the cross-flow fan of this invention, FIG. 2 is a cross section cut along the line shown by the arrows A—A of FIG. 1, and FIG. 3 is an enlarged cross section of a vane of FIG. 1.

Figure 2:
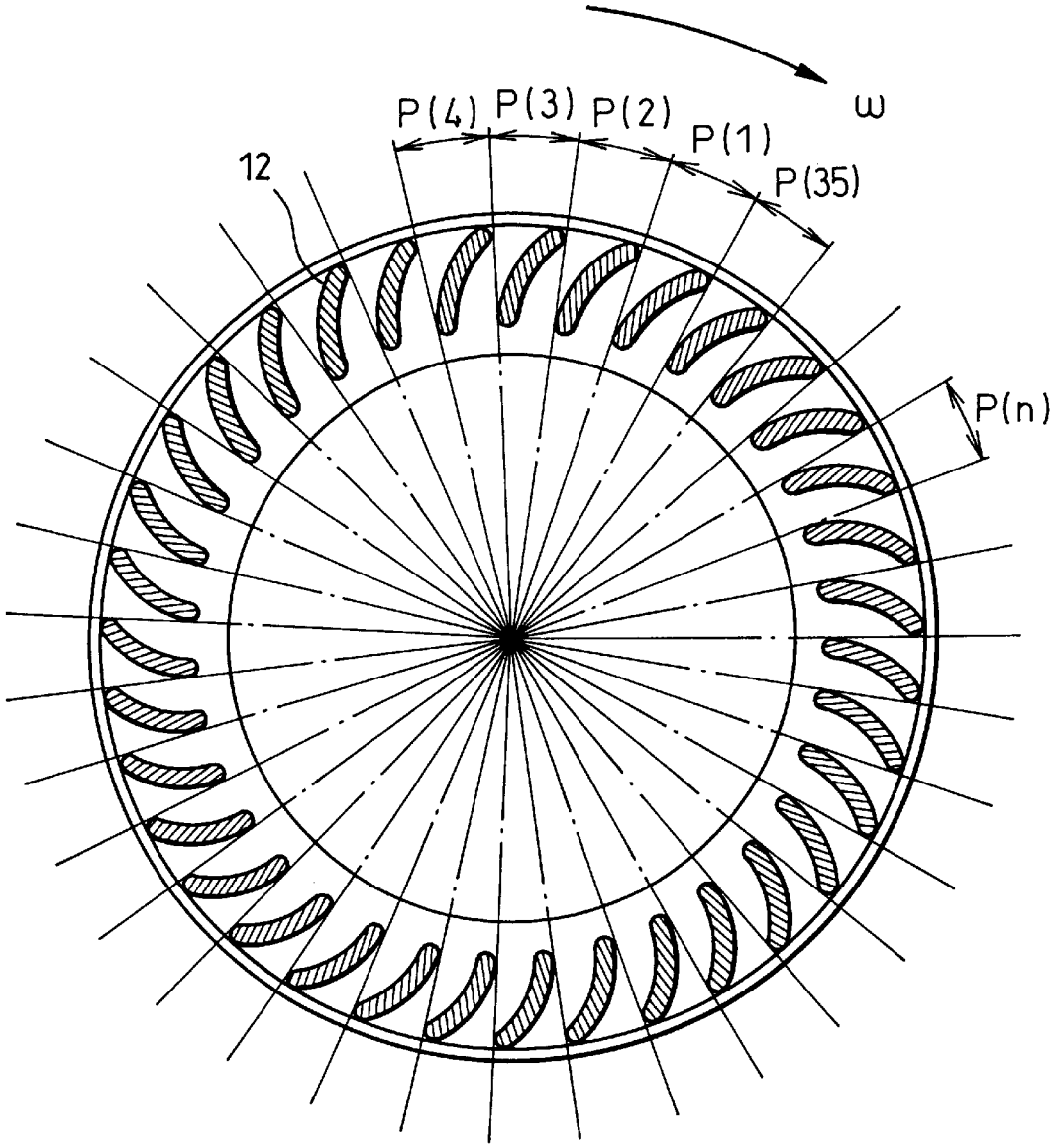
FIG. 2 is a cross section cut along a line shown by the arrows A—A of FIG. 1.
Figure 3:
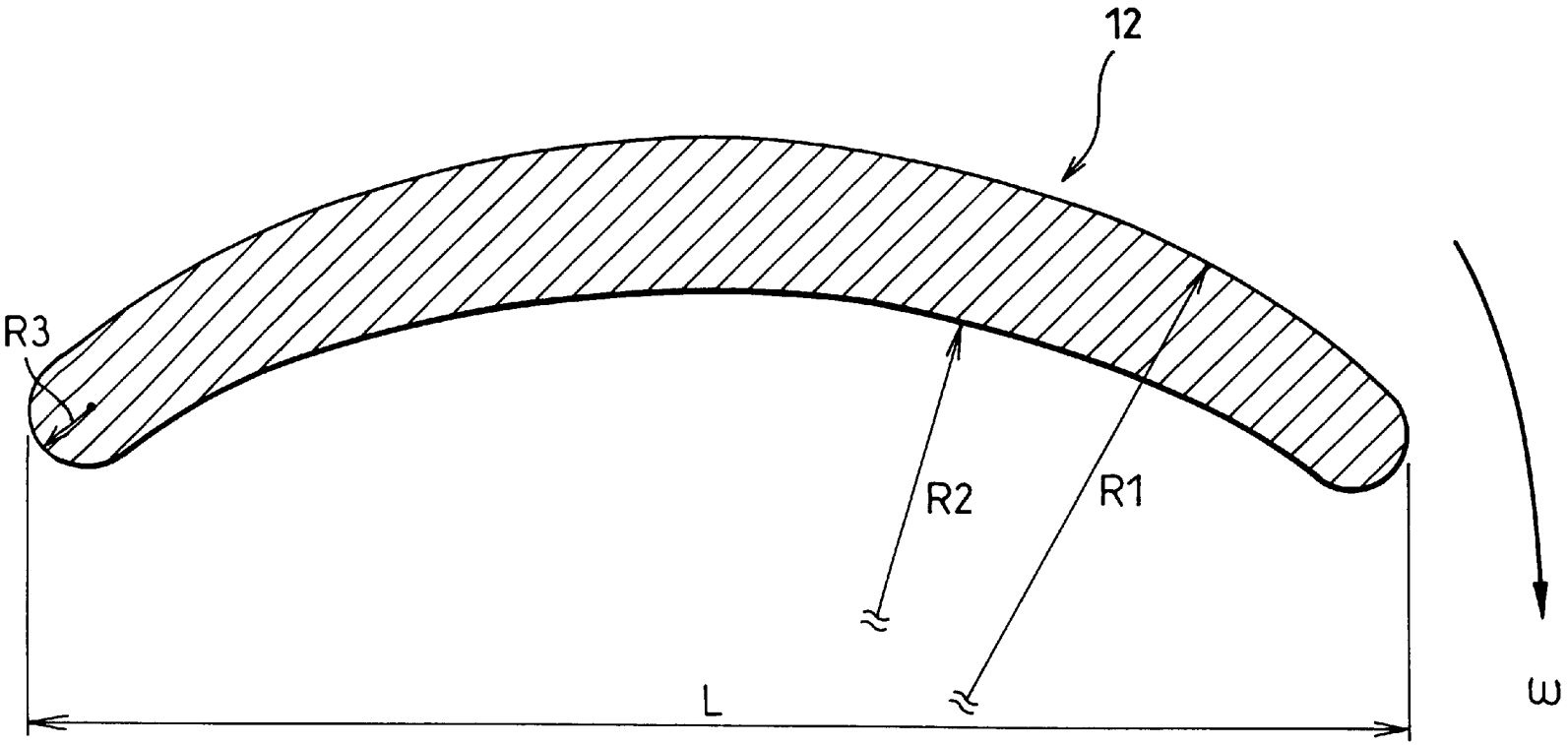
FIG. 3 is an enlarged cross section of a vane.

As shown in FIGS. 1 and 2, a plurality of supporting disks 13 are disposed substantially equidistantly along a rotary shaft 14 of the cross-flow fan 11. A plurality of vanes 12 are disposed around the peripheries of the supporting disks 13 so as to surround the shaft 14.

A motor (not shown) is connected to one end 14*a* of the shaft 14 such that the shaft 14 is rotated in a direction ω, as shown by the arrow. The approximate dimensions of an embodiment of the cross-flow fan 11 are as follows: the radius of the fan D4 is 88 mm and its axial length L2 is 600 mm.

Each fan 12 extends along the rotary shaft 14 and forms a so-called skew such that the end on the side to be driven advances more in the direction of rotation ω than the end on the side to drive. In the embodiment, as shown in FIG. 1, an angle of twist θ, formed over the shaft by the vane 12 with the shaft, is set at 43 degrees.

FIG. 3 shows a cross section, in a direction of its shorter side, of the vane 12. The vane 12 is formed into a circular arc and is mounted on the supporting 13 so that its concave surface faces the direction of rotation ω. The dimensions of the vane 12 are as follows: the length of an arc L is 11.7 mm, the radius of the back side of an arc R1 is 9 mm, the radius of the front side of an arc R2 is 10 mm, and the radius at the end of an arc between its front and back sides R3 is 0.44 mm.

Angular intervals between adjacent vanes 12 in a peripheral direction are determined based on chaos logic or theory. That is, when the total number of vanes 12 is assumed to be B, and when an angle formed between the nth and (n+1)th vanes 12 centered around the rotary shaft 14 is assumed to be P(n), chaotic progression or pseudorandom numbers corresponding to each vane 12 is found based on a logistic function defined by equation 2, and then angles or pitches are determined per equation 3 by using the chaotic progression. Further, the total number B of the vanes 12 is assumed to be 35.

$$X(n+1)=4\times(1-X)(n))\times X(n) \quad (2)$$

Where X(1)=0. 1, and n=1–B (integers)

$$P(n)=a+b\times X(n) \quad (3)$$

Where a is a constant ranging from 297/B to 333/B, b is also a constant ranging from 2.0 to 3.0, and P(1) is an angular interval formed by the 1st vane 12 with the Bth vane 12. The cross-flow fan 11 is formed such that each vane 12, whose an angular interval has thus been determined, is sequentially disposed in the direction of rotation ω.

If the sum of the angular intervals P(1)–P(35) of all the vanes 12 does not always total 360 degrees, the sum may be made to total 360 degrees by adjusting, for example, the angular interval P(35) of the last vane 12.

Table 1 lists the values of the angular intervals of each vane 12. They have been determined in the manner stated above.

TABLE 1

| Nos. of vanes n | Ang. int. P (n) deg. | Nos. of vanes n | Ang. int. P (n) deg. |
|---|---|---|---|
| 1 | 9.30 | 19 | 9.63 |
| 2 | 9.95 | 20 | 10.83 |
| 3 | 11.35 | 21 | 11.10 |
| 4 | 9.77 | 22 | 10.53 |
| 5 | 11.10 | 23 | 11.47 |
| 6 | 10.51 | 24 | 9.37 |
| 7 | 11.48 | 25 | 10.15 |
| 8 | 9.33 | 26 | 11.52 |
| 9 | 10.05 | 27 | 9.18 |
| 10 | 11.45 | 28 | 9.56 |
| 11 | 9.42 | 29 | 10.67 |
| 12 | 10.31 | 30 | 11.33 |
| 13 | 9.05 | 31 | 9.85 |
| 14 | 9.05 | 32 | 11.23 |
| 15 | 9.06 | 33 | 10.17 |
| 16 | 9.09 | 34 | 11.52 |
| 17 | 9.20 | 35 | 10.84 |
| 18 | 9.63 | | |

Figure 6:
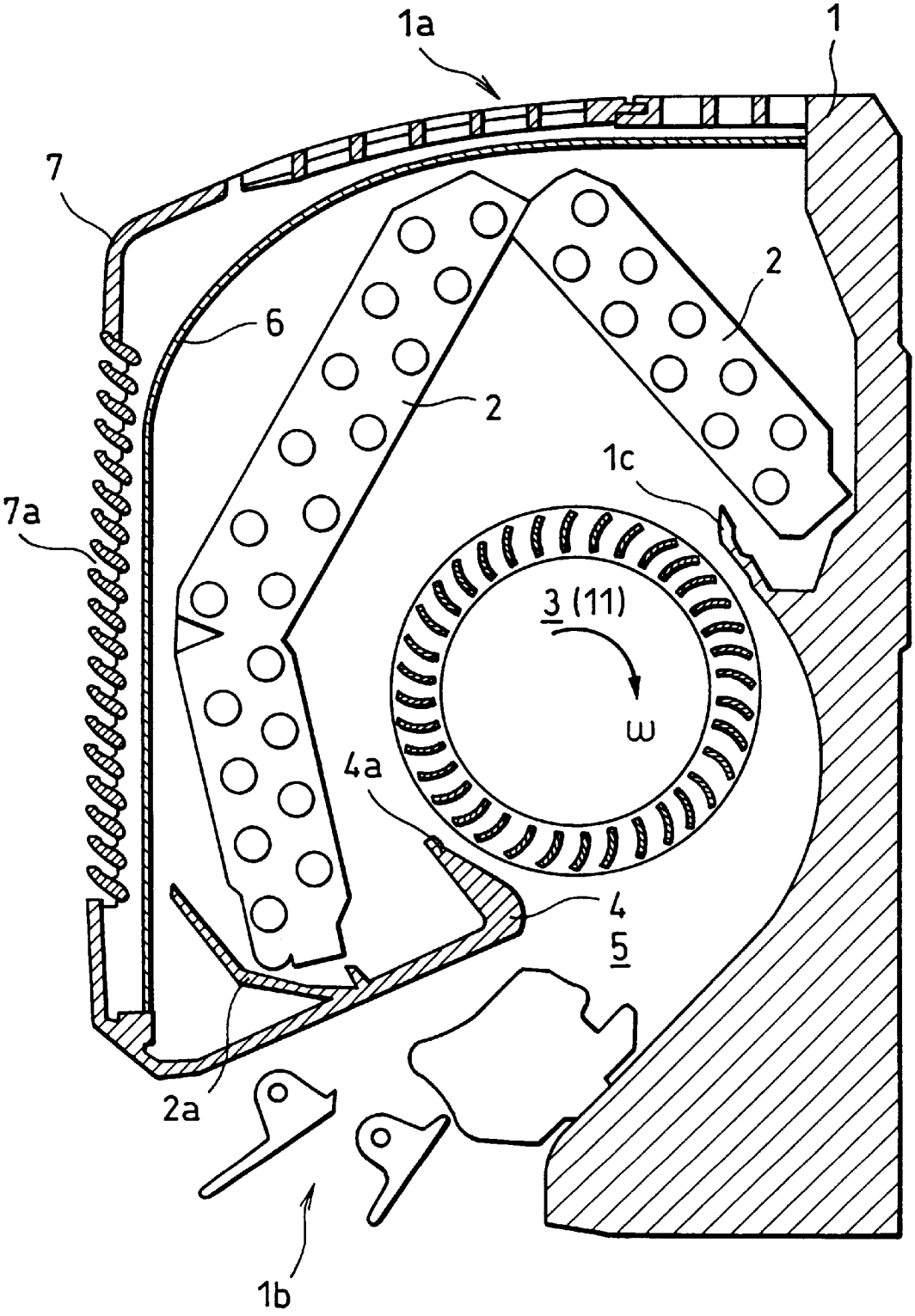
FIG. 6 is a cross section of a room unit showing an embodiment of this invention.
Figure 7:
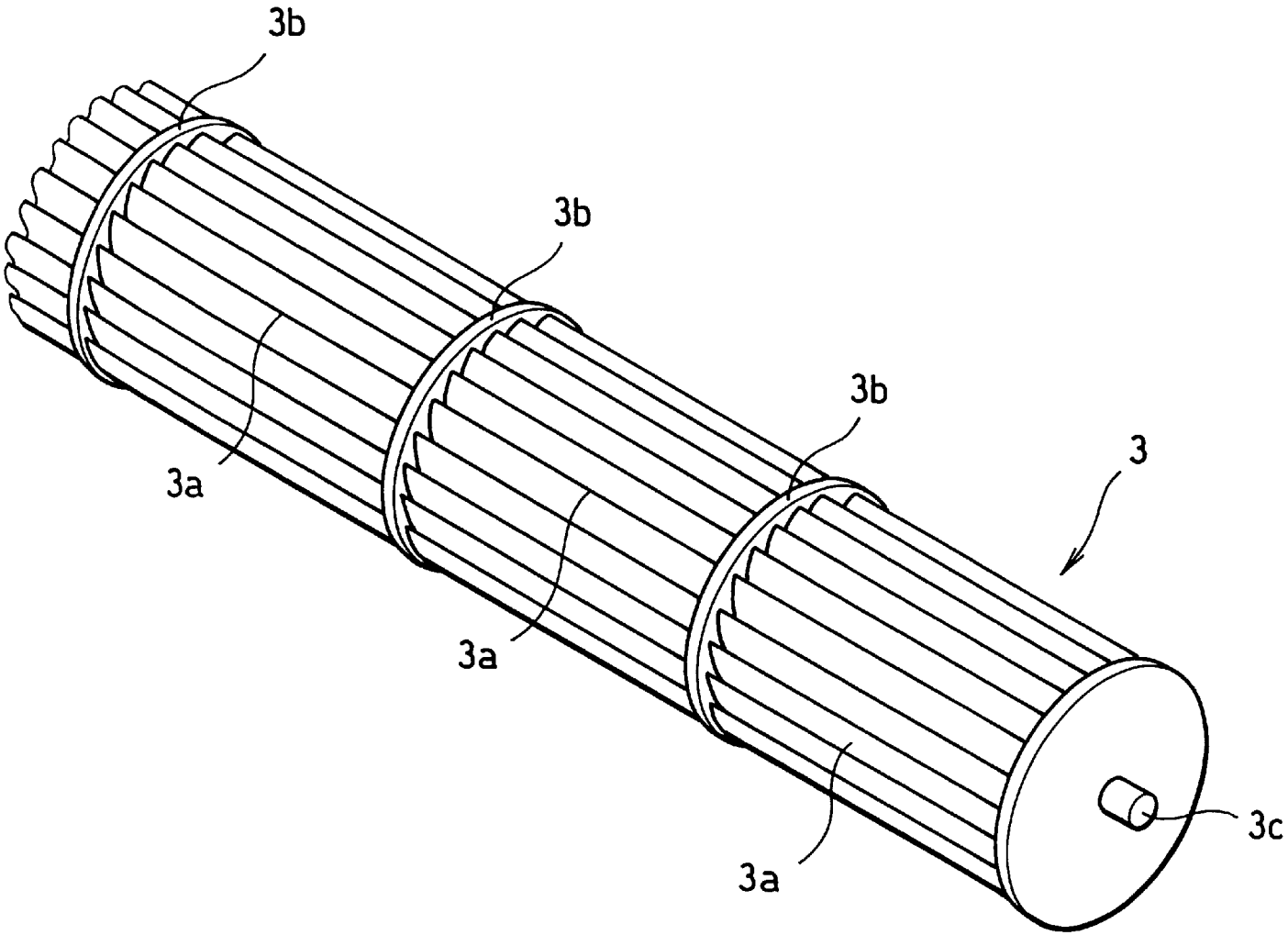
FIG. 7 is an enlarged perspective showing the main part of the conventional cross-flow fan.

Thus, the angular intervals of vanes 12, other than P(35), have been determined by the logistic representation. The thus-constituted cross-flow fan 11 is mounted on a indoor unit shown in FIG. 6. An air-conditioner to which this indoor unit is applied comprises a compressor to compress a heat medium, a decompressor to decompress or squeeze the heat medium, a condenser to condense the heat medium, and an evaporator to evaporate the heat medium.

In a cooling operation, a room is cooled such that a heat exchanger 2 is disposed in the indoor unit. It functions as an evaporator to exchange heat between the heat medium and the air that is in the room and that is circulating through the heat exchanger 2, such that the heat medium evaporates by receiving the heat of evaporation from the room air. The room air is in turn cooled by having been taken away the heat of evaporation to cool the room.

On the other hand, in a warming operation, a room is warmed such that a heat exchanger 2, disposed in the indoor unit, functions as a condenser to exchange heat between the heat medium and the air in the room that is circulating through the heat exchanger 2, and such that the heat medium condenses by the heat of condensation having been taken away by the room air. The room air is in turn warmed by receiving the heat of condensation to warm the room.

Further, it is also possible to exchange heat between warm or cool water circulating through the heat exchanger 2 as a heat medium and the air in a room. In this case, warming and cooling operations are carried out by the radiation or absorption of heat in the heat exchanger 2.

In an indoor unit, inlets 1*a* and 7*a,* provided in upper and front covers of a case 1 of the body of the unit, and an outlet 1*b,* provided in a bottom portion of the body case 1, define a flow path 5. In the flow path 5, an air filter 6, a heat exchanger 2, and a cross-flow fan 11 are disposed sequentially, starting from the windward side.

The cross-flow fan 11 is driven by an electric motor (not shown), and structured such that it is sandwiched between a rear-guider 1*c* and a stabilizer 4 equipped with a tong-shaped surface 4*a* at an end thereof so as to enhance the efficiency in blowing the air. The rear-guider 1*c* may be replaced by a rib functioning as a rectifier. A drain pan 2*a* (a pan for receiving water) is formed at the lower end of the stabilizer 4 for receiving water flowing down from the heat exchanger 2 to remove frost.

Further, the cross-flow fan is appropriately arranged so that its lowest point is positioned higher than that of the heat exchanger.

This is because the air passing through the lower part of the heat exchanger 2 can also be absorbed and discharged so as to allow the heat exchanger 2 to be used effectively.

The results of noise experiments carried out by using the cross-flow fan 11 of the above-mentioned structure will now be explained.

In one experiment, the present invention was compared with the conventional one, wherein the angular intervals of each vane 12 were appropriately set at random to reduce first-order rotary sounds (NZ sounds), so as to support the effects of this invention.

Figure 4:
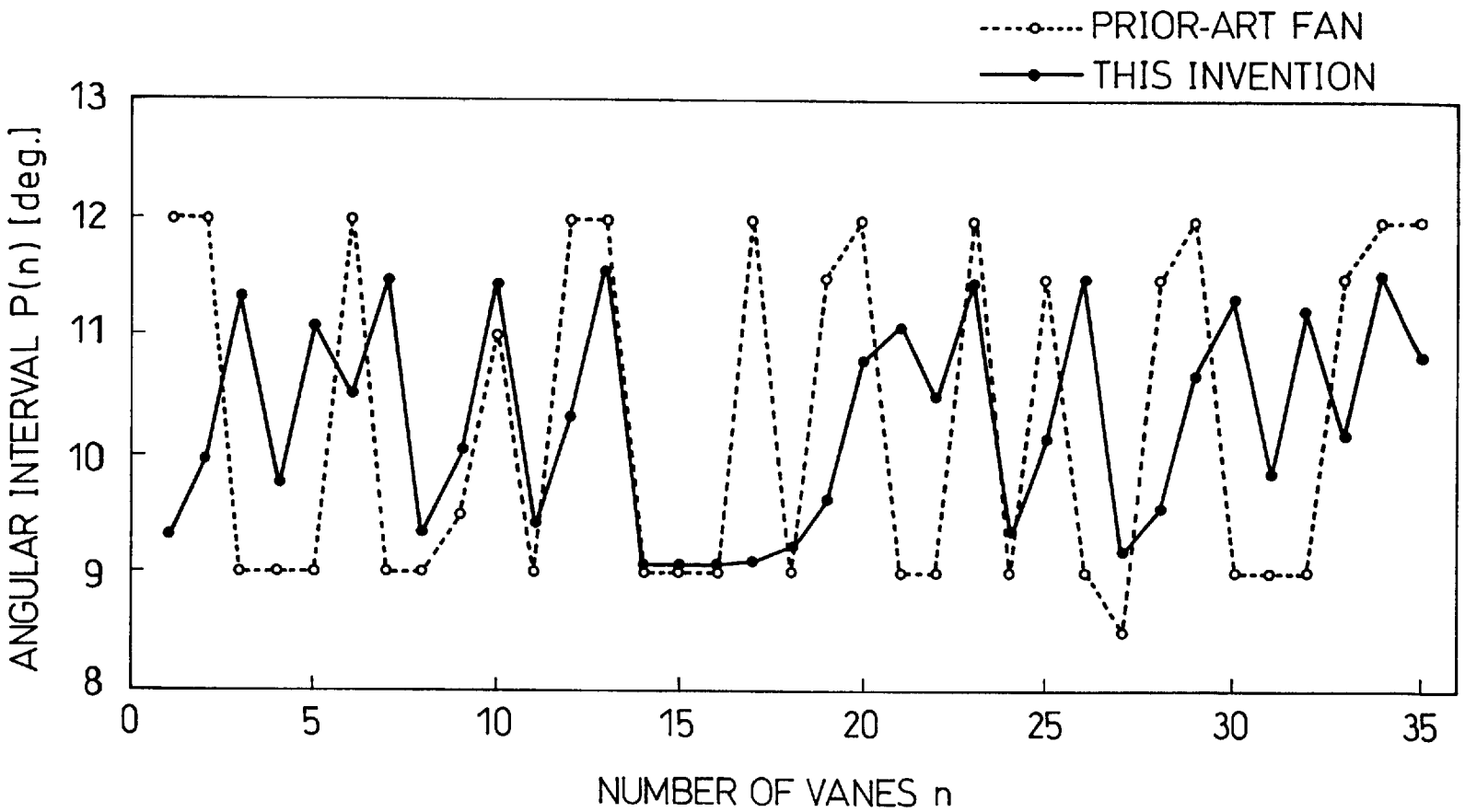
FIG. 4 is a schematic showing angular intervals of the cross-flow fans spaced in accordance with the constitutions of the prior art and this invention.

FIG. 4 shows angular intervals of cross-flow fans 11 in accordance with the structures of both a conventional fan and this invention. The abscissa axis of FIG. 4 shows the number of each vane 12, ranging from 1 to 35, and the coordinate axis shows angular intervals P(n), corresponding to each vane 12.

Figure 5:
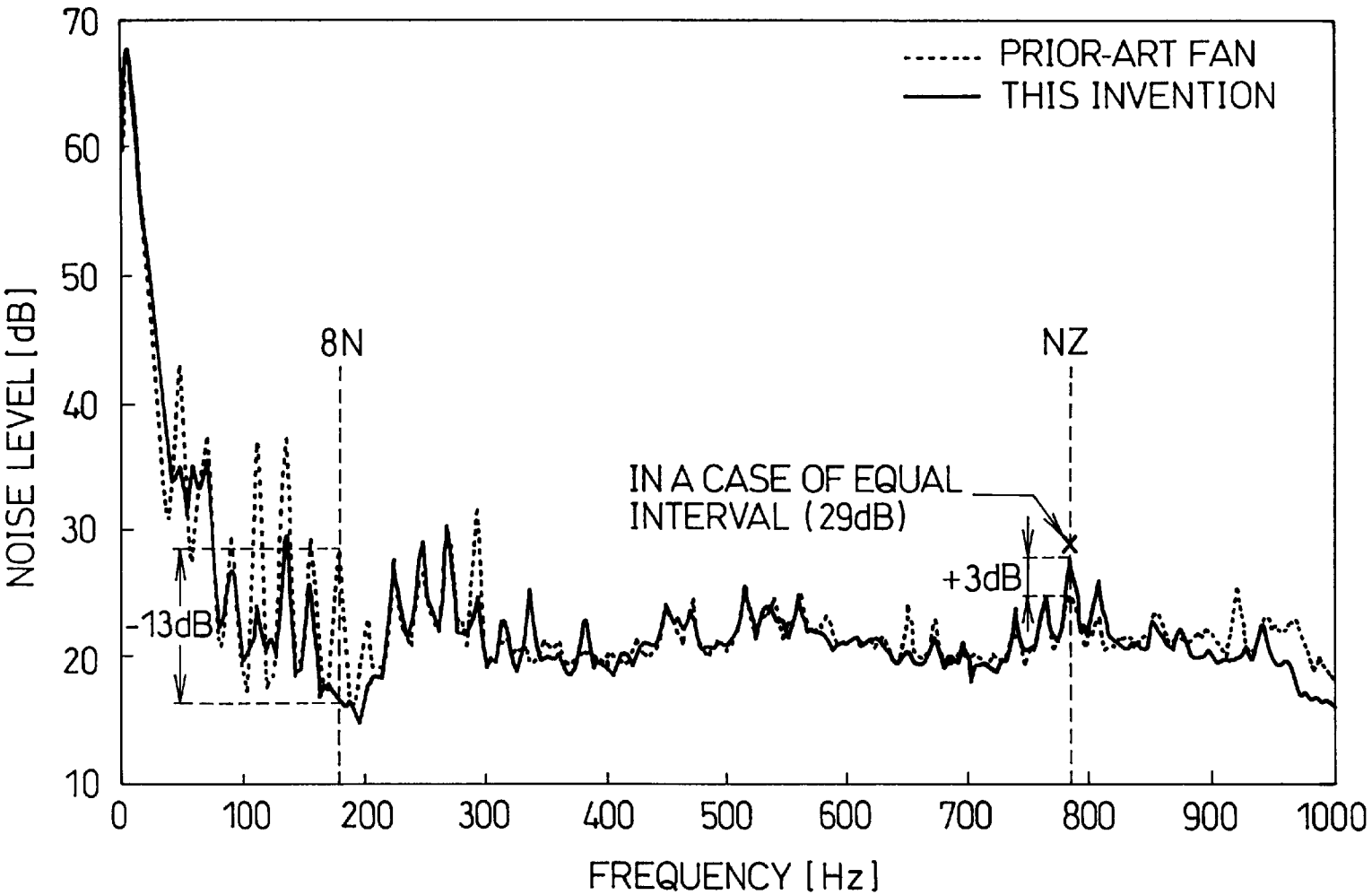
FIG. 5 shows the results of noise experiments derived from the experiments on the angular intervals shown in FIG. 4 of the products carried out in accordance with the prior art and this invention.

FIG. 5 shows the results of noise experiments when the cross-flow fans 11, whose angular intervals have been set as shown in FIG. 4, are rotated at a speed of 1360 rpm. The abscissa axis of FIG. 5 shows frequencies (Hz) of noises, and the coordinate axis shows noise levels (dB).

As can be seen from FIG. 5, the noise levels at the frequencies of rotary first-order sounds NZ (793 Hz) are 24 dB and 27 dB for the conventional fan and this invention, respectively. Although this invention shows a noise level higher than that of the conventional device, there is little difference therebetween.

Further, the mark X in FIG. 5, which indicates a value of 29 dB, shows the result of rotary first-order sounds when the angular interval or pitch of each vane 12 is constant.

On the low-frequency side, the noise levels at 8N (8N= 181 Hz) are 29 dB and 16 dB for the conventional fan and this invention, respectively. The result of an experiment shows that the noise levels for this invention are considerably lower than those of the conventional fan, and that little variation of noise levels is observed in the range of frequencies around that frequency.

From the above descriptions, it can be seen that the structure of this invention allows a reduction in both the noise levels caused by rotary first-order sounds and the intensity and variation of noise levels at around 8N on the lower frequency side.

Thus, noises at around 8N on the lower frequency side will not give an unpleasant impression to listeners, such as was experienced in using the conventional fan.

In the conventional fan, an eddy is produced at the root of the tongue-shaped surface 4*a* by a flow of air passing through the lower part of the heat exchanger 2. If such an eddy is synchronized with another eddy that is generated when the eddy produced at the root of the tongue surface is discharged from the cross-flow fan 11 and impinges on the tongue surface, noises increase.

However, the cross-flow fan 11, in accordance with the structure of this invention, allows noise components to be dispersed in a wider frequency band, to prevent noise levels from considerably increasing in a certain frequency area.

Further, a manufacturing error is inevitable when manufacturing the cross-flow fan 11. However, it was found that if the following relationship expressed by equation 4 is met, the above-mentioned noise-preventing effect of this invention can be realized within a tolerable range:

$$-1.0 \leqq \delta P(n) \leqq 1.0 \tag{4}$$

Where δP(n) is assumed to be manufacturing errors.

In the experiments explained above, it was assumed that the total number of vanes 12 was 35, the skew or twist angle was 43 degrees, and vanes 12, whose angular intervals P(1)–P(35) were determined based on chaos logic were sequentially disposed in the direction of rotation ω. However, this invention is not restricted by these conditions, and can even achieve results similar to the above under any other conditions.

It should be understood that the above-described embodiments are merely illustrative, and not intended to restrict or reduce the scope of the inventions stated in the attached claims. Of course numerous other embodiments can be readily devised in accordance with the techniques stated within the claims.

For example, in the above-mentioned embodiments, the total angular interval of 360 degrees is achieved by adjusting the last interval P(35). However, it is not so limited, and the vane 12 can be adjusted to any other interval.

Another embodiment is also possible, wherein each of the above-mentioned angular intervals P(n) can be adjusted respectively to each of angular intervals P'(n), as determined by the following equation 5:

$$P'(n) = P(n) \times \frac{360}{\sum_{i=1}^{35} P(i)} \tag{5}$$

In accordance with this structure, all the vanes 12 can be arranged in a well-balanced way, with angular intervals determined by the logistic representation.

Also, the method of manufacturing the cross-flow fan 11, is not limited to the method of combining one of the vane 12 with a plurality of supporting disks 13. Any other method can also be used, wherein a plurality of vane 12 are mounted on the peripheries of a single supporting disk 13, and the resulting assemblies are stacked sequentially or may be formed into one unit (or divided into a plurality of units) by using plastics.

Alternatively, separate shafts to be provided at the ends of both the sides of the cross-flow fan 11, instead the through shaft 14 passing through the longitudinal axis of the cross-flow 11, may be chosen depending on the method of forming the above-mentioned supporting disks.

What is claimed is:

1. A cross-flow fan comprising:

a multiplicity of disks for supporting on the circumferences thereof a multiplicity of vanes, wherein the multiplicity of vanes are disposed along said circumferences of said disks at intervals which are determined based on the following logistic formula:

$$X(n+1)=A*(1-X(n))*X(n)$$

where n is an integer;

A is a constant;

X(1) is equal to 0.1.

2. The cross-flow fan as set forth in claim 1, wherein said multiplicity of vanes are angularly spaced apart such that the angle between the n-th and (n+1)th vanes with respect to the axis of the shaft of said fan is determined by the following formula:

$$P(n)=a+b*X(n)$$

where a and b are constants.

3. A cross-flow fan of claim 2, wherein the angular interval P(n) of any arbitrarily chosen vane is adjusted so that the total of angular intervals P(1)–P(B) of all the vanes becomes 360 degrees, wherein B is the maximum number of vanes.

4. A cross-flow fan of claim 3, wherein the angular interval P(B) of the Bth vane is adjusted.

5. A cross-flow fan of claim 2, wherein each of the angular intervals P(n) is respectively adjusted to obtain the counterpart angular interval from P'(n) determined by the following equation 5:

$$P'(n) = P(n) \times \frac{360}{\sum_{i=1}^{B} P(i)}, \quad (5)$$

6. A cross-flow fan of any one of claims 3 to 5, wherein said number of vanes are sequentially disposed in the rotary direction of the cross-flow fan at angular intervals as determined by the logistic representation.

7. A cross-flow fan of any one of claims 3 to 5, wherein manufacturing errors δP(n) in manufacturing the angular interval P(n) of the nth vane are formed so as to meet the following equation 4:

$$-1.0 \leqq \delta P(n) \leqq 1.0 \quad (4).$$

8. An air-conditioner according to any one of claims 3 to 5, wherein an air inlet, a heat exchanger, said cross-flow fan, and an outlet are disposed sequentially starting from a windward side, and wherein said cross-flow fan circulates via the heat exchanger, air in a room to be air-conditioned so as to air-condition the room by heat exchanging a heat medium flowing through the heat exchanger with the air.

9. An air-conditioner of claim 8, wherein said cross-flow fan is sandwiched between a rear-guider and a stabilizer, and wherein said rear-guider, outlet, and stabilizer are sequentially disposed in the same direction as the rotary direction of said cross-flow fan.

10. An air-conditioner of claim 8, wherein said cross-flow fan is disposed so that the lowest point thereof is positioned higher than the lowest point of said heat exchanger.

11. An air conditioner of claim 9, wherein said cross-flow fan is disposed so that the lowest point thereof is positioned higher than the lowest point of said heat exchanger.

12. The cross-flow fan as set forth in claim 2, wherein a is a number in the range from 297/B to 333/B inclusive, with B being the total number of vanes;

n is an integer in the range from 1 to B inclusive;

b is a constant in the range from 2.0 to 3.0 inclusive;

P(B) is the angle between the B-th and the first vanes.

* * * * *